US010711549B2

(12) United States Patent
Courville

(10) Patent No.: US 10,711,549 B2
(45) Date of Patent: Jul. 14, 2020

(54) LOCKING MANDREL AND RUNNING TOOL COMBINATION

(71) Applicant: Adam Courville, Singer, LA (US)

(72) Inventor: Adam Courville, Singer, LA (US)

( * ) Notice: Subject to any disclaimer, the term of this patent is extended or adjusted under 35 U.S.C. 154(b) by 163 days.

(21) Appl. No.: 15/694,648

(22) Filed: Sep. 1, 2017

(65) Prior Publication Data

US 2018/0066487 A1 Mar. 8, 2018

Related U.S. Application Data

(60) Provisional application No. 62/383,183, filed on Sep. 2, 2016.

(51) Int. Cl.
*E21B 23/02* (2006.01)
*E21B 23/01* (2006.01)

(52) U.S. Cl.
CPC ..... *E21B 23/02* (2013.01); *E21B 23/01* (2013.01)

(58) Field of Classification Search
CPC ..... E21B 23/02
See application file for complete search history.

(56) References Cited

U.S. PATENT DOCUMENTS 3,130,788 A 4/1964 Cochran et al.
3,507,329 A 4/1970 Stone, Jr.
3,568,770 A 3/1971 Fredd
3,744,564 A 7/1973 Mott
3,963,074 A 6/1976 Spriggs
3,977,482 A 8/1976 Reed et al.
4,023,620 A * 5/1977 Gazda ..... E21B 23/02 166/217
4,134,452 A 1/1979 Kingelin
4,256,180 A 3/1981 Mott
4,294,315 A 10/1981 Yonker et al.
4,315,544 A 2/1982 Monauni et al.
4,362,211 A 12/1982 Fisher, Jr.
4,378,839 A * 4/1983 Fisher, Jr. ..... E21B 23/02 166/217
4,396,061 A 8/1983 Tamplen et al.
4,403,657 A 9/1983 Adams, Jr.
4,418,750 A 12/1983 Paschal, Jr.
4,479,539 A * 10/1984 Tamplen ..... E21B 23/02 166/212
4,545,434 A * 10/1985 Higgins ..... E21B 23/02 166/217
4,745,974 A 5/1988 Higgins
4,844,160 A 7/1989 Gazda
4,969,515 A 11/1990 Dollison
4,997,038 A 3/1991 Welch
5,040,598 A 8/1991 Pleasants
(Continued)

OTHER PUBLICATIONS

Hunting Halliburton, Wireline Operations: Pulling Tools.

*Primary Examiner* — Kipp C Wallace

(57) ABSTRACT

A locking mandrel and running tool combination for setting equipment such as flow control devices in wellbore tubing is disclosed. The apparatus uses a translatable collet to move an expander mandrel to wedge against inwardly biased locking keys to force the locking keys outward into the recesses of landing nipples in the wellbore tubing. The translatable collect is released to move only b upward shearing forces on retaining pins and the running tool is released from the locking mandrel only by upward rather than downward shearing forces on retainer pins.

15 Claims, 10 Drawing Sheets

(56) References Cited

U.S. PATENT DOCUMENTS

| | | | | |
|---|---|---|---|---|
| 5,082,061 | A | 1/1992 | Dollison | |
| 5,409,059 | A | 4/1995 | McHardy | |
| 5,507,348 | A | 4/1996 | Van Steenwyk et al. | |
| 6,929,063 | B2 | 8/2005 | Reese et al. | |
| 8,371,375 | B2 | 2/2013 | Garr et al. | |
| 8,474,542 | B2 | 7/2013 | Blanton et al. | |
| 8,839,872 | B2 * | 9/2014 | Purkis | E21B 23/02 166/386 |
| 2012/0012338 | A1 * | 1/2012 | Blanton | E21B 23/02 166/382 |

* cited by examiner

LOCKING MANDREL AND RUNNING TOOL COMBINATION

PRIORITY

This application claims priority to U.S. Provisional Application Ser. No. 62/383,183 filed Sep. 2, 2016 entitled "Locking Mandrel and Running Tool Combination", the entire content of which is hereby incorporated by reference.

FIELD OF INVENTION

This invention relates to locking tools for use in wellbore tubing and, more particularly relates to a locking mandrel and running tool combination for releasably locking the locking mandrel and an attached wellbore flow control device in wellbore tubing.

BACKGROUND

A tubing locking mandrel is used for attaching wellbore tools such as a flow control device to the interior of wellbore tubing and is deployed in the wellbore by a running tool inserted into the wellbore tubing, by wireline, slickline, coiled tubing, or the like. The current locking mandrels will have an outer profile configured to engage with a corresponding interior recess or locking profile of a downhole landing "nipple" incorporated into the wellbore tubing. An example of such a locking: mandrel is an OTIS® X® lock which designed to mate with the locking profile of an OTIS® XN® landing nipple. These locking mandrels have locating dogs and spring loaded lock keys that are used to locate the corresponding locking profile and lock the locking mandrel in place onto the landing nipple. Such locking mandrels are considered "selective" locking mandrels because when inserted into the wellbore tubing, the locking mandrels can be moved downhole through multiple landing nipples along the wellbore tubing to a depth or wellbore position where a desired landing nipple is located.

Tubing locking, mandrels are locked or set into a landing nipple by attaching the locking mandrel to a running tool and inserting the running tool and attached locking mandrel into the wellbore tubing and then moving the running tool and locking mandrel to a position beyond the desired landing nipple. The running tool and locking mandrel are then pulled upward in the wellbore tubing until the locating dogs on the running tool engage with or catch the corresponding locking profile in the desired landing nipple. The locking mandrel is then pulled further upward with sufficient force to shift the locking mandrel into a "controlled position" to where it is then pulled further upward to a position above the desired landing nipple. After being so positioned, the locking mandrel and running tool is then lowered until the spring loaded lock keys of the locking mandrel sit upon a matching shoulder in the desired landing nipple preventing further downward movement of the locking mandrel. A downward force is then applied on the locking mandrel, through jarring or by the sit down weight of the coiled tubing and attached tools, to shear a pin in the running tool and shift a sleeve on the locking mandrel, sometimes called an "expander mandrel", to a position behind the lock keys to prevent the spring loaded lock keys from collapsing back into the body of the locking mandrel. An upward force is then applied on the running tool and attached locking mandrel to shear a core retainer pin holding the locking mandrel to the running tool. When the core retainer pin holding the running tool to the locking mandrel is sheared, the running tool may then be pulled out of the wellbore tubing leaving the locking mandrel set in place on the landing nipple.

Current tubing locking mandrels have a number of design deficiencies which often prevent these locking mandrels from being properly set into a landing nipple without costly and time consuming problems. Current tubing locking mandrels typically have a lock body with an enlarged outer diameter or O.D. and thermoplastic seals called Vee packing stacks. The lock body and Vee packing stacks must be moved past restricted or constricted sections in the wellbore tubing such as tubing connections (especially over-torqued tubing connections), landing nipple profiles, and other restrictions in the wellbore tubing, such as paraffin wax or a build-up of scale, hydrate, asphaltene or corrosion. The only way to move the locking mandrels beyond the wellbore the restrictions is to use a jarring tool to apply an impact load or jar down on the running tool and subsequently the locking; mandrel.

When jarring on current running tools and locking mandrels in order to move beyond a tubing restriction, such jarring often results in prematurely shearing the top "setting" shear pin of these running tools. Often when jarring a running tool and locking mandrel past a wellbore restriction, the jar, the running tool and the attached locking mandrel will fall through the restriction to a position where they are abruptly stopped. This abrupt stopping will often cause a lower retainer pin in the running tool to shear. The shearing of any attachment pin in a running tool or locking mandrel can and usually does prevent the locking mandrel from setting properly into a landing nipple. These problems frequently occur when running tools ale worn, damaged, or have not been properly maintained.

A wellbore may be drilled as a "horizontal" well that deviates substantially from vertical. Attempting to jar down on current running tools to set a locking mandrel in a deviated wellbore can be problematic because the wellbore geometry makes it difficult to apply the jarring force needed to shear the setting pins and set the locking mandrel. The difficulty associated with applying these downward jarring forces in "horizontal" wellbores increases the time associated with setting the locking mandrel and increase the risk that the locking mandrel will be not be properly set in the landing nipple and that it will be set in an undesirable location. Similar problems occur when current locking mandrels are being run into a wellbore that has heavy or viscous wellbore fluids. Heavy or viscous wellbore fluids will often impede the jarring forces required to shear, the setting pins in current running tools.

Paraffin buildup in a wellbore that has not or cannot be completely cleared also presents problems when setting a locking mandrel. Even a slight amount of paraffin on the interior of the wellbore can inwardly compress the lock keys in current locking mandrels. Because the kick keys are forced outward from the locking mandrel by means of springs, paraffin buildup in the wellbore may prevent the lock keys from moving sufficiently outward from the locking mandrel to locate the landing nipple when setting the tool.

Running and setting a locking mandrel will frequently require the use of a "check set" tool that is run into the wellbore to the depth of the locking mandrel and then manipulated to shear a pin to insure the locking mandrel is properly set in the desired landing nipple. The use of a check set tool increases time and expense associated with setting a locking mandrel. The need to run an additional tool also increases the risk that tool or the wireline will be lost in the wellbore tubing requiring difficult and time consuming fishing operations.

SUMMARY OF THE INVENTION

Applicant discloses a new locking mandrel and running tool combination that eliminates or reduces the severity of many of the deficiencies associated with running and setting current tubing locking mandrels.

The new locking mandrel and running tool combination may be deployed by slickline, wireline, coiled tubing string or other running device. The running tool is comprised of an upper housing with a collet shifter and a translatable actuation rod. The translatable actuation rod is translatably attached to the upper housing by a retainer pin positioned in a retainer pin translation slot in the upper housing. A tension spring in the housing provides a downward bias or shift to the actuation rod. A setting prevention shear pin is also positioned in the upper housing through a longitudinal slot in the actuation rod.

The collet shifter extends longitudinally downward from the upper housing and has a central core for receiving the translatable actuation rod and a flexible central collet section that retains a translatable collet. The collet shifter may be an integral part of the housing or the collet shifter may be a separate component attached to the upper housing by bolts, pins, screws, attachment threads, or other suitable attachment mechanisms.

The locking mandrel is comprised of an outer tubular lock housing having an interior central core and interior and exterior housing surfaces. The tubular lock housing retains an expander mandrel receiver, a translatable expander mandrel, the translatable collet, and a plurality of locking keys between an upper fishing neck and a lower threadedly attached packing mandrel. The expander mandrel receiver has an annular interior ball detent that extends around its interior surface. The outer lock housing is retained around a neck section of the expander mandrel receiver where it may restrictively translate upward and downward. Lock housing shear pins, shear screws, or their equivalents may be used to releasably attach the lock housing to the expander mandrel in a fully upward position with respect to the fishing neck. The expander mandrel has an upper end with a plurality of ball recesses, upper and lower outwardly extending radial shoulders, an inwardly extending interior shoulder, and an annular collet firmer detest that extends radially around its interior surface.

The translatable collet is translatably mounted onto the collet shifter of the mining tool and fitted within the expander mandrel. The translatable collet has a plurality of collet fingers, each with an outward ex ending collet finger shoulder that is configured to engage with the interior shoulder of the expander mandrel. The locking keys are attached to the lock housing adjacent keyway openings and are inwardly biased by leaf springs attached to the lock housing. A packing mandrel shear pin at the lower end of the actuation rod of the running tool attaches the packing mandrel to the lock housing.

The new locking mandrel and running tool combination may be run into the wellbore by wireline, coiled tubing, slickline, or the like and moved downward through as many downhole nipples as necessary to reach a desired nipple where the locking mandrel is to be set. When the desired nipple is located, the locking mandrel is moved downward beyond the desired landing nipple and then pulled upward. This upward movement shifts the upper housing of the running tool with the attached collet shifter upward in relation to the attached mandrel housing. If there is sufficient space hi the wellbore tubing, such as when the locking keys are adjacent the locking profile of in the nipple, the locking keys will move outwardly through the adjacent housing keyway openings into the recesses of the locking; profile of the nipple. With the locking keys recessing into the nipple profile, the upper housing of the running tool and the attached actuation rod and collet shifter are translated upwards and jarred until the setting prevention shear pin is sheared to allow the housing and collet shifter to be completely shifted upward to set the locking mandrel.

When so shifted, ball bearings at the upper end of the expander mandrel are forced outward by the translating collect into the corresponding interior ball detent in the expander mandrel receiver. The translating collet is thereby allowed to continue to travel upward where the collet finger shoulders on the collet fingers expand to engage with the collet finger detent in the expander mandrel. The engagement of the expanded collet finger shoulders on the collet fingers with the collet finger detent in the expander mandrel collapses the flexible central collet section and central shoulders of the collet shifter allowing the central collet section of the collet shifter and the collet to move into the expander mandrel receiver, keeps the translatable collet firmly behind the ball bearings, and locks the expander mandrel into the expander mandrel receiver.

The upward translation of the collet shifter, collet, and expander mandrel will also engage the lower outwardly extending radial shoulders of the expander mandrel with the locking keys and fully push the locking keys outwardly into the recess of the locking profile of the nipple to set the locking mandrel. The running tool is then jarred upward to shear the retainer shear pin attaching the actuation rod of the running tool to the packing mandrel of the lock housing to allow the running tool to be removed from the wellbore tubing.

If the locking mandrel must be pulled from the wellbore tubing at a later date a pulling tool may be used to latch into the fishing neck at the top of the locking mandrel. Upward force or jarring on the fishing neck will shear the lock housing shear pins allowing the expander mandrel receiver and connected expander mandrel to be shifted upward to a point above the locking keys are clear of the housing keyway opening. When the keyway opening is cleared, the inwardly biased locking keys will retract inward from the for recesses of the nipple into the lock housing to allow the locking mandrel to be freely pulled from the nipple and out of the wellbore tubing.

An advantage of the new running tool and lock mandrel combination is that the new locking mandrel may be set and locked with the need of downward jarring to shear retaining pins. Because downward jarring is not required to shear setting pins, the locking mandrel may be jarred downward as much and as hard as needed to push the running tool and locking mandrel past wellbore tubing restrictions without the risk of premature pin shearing.

Another advantage of a locking mandrel and running tool combination that sets without downward force on the shear pins is that the problems associated with running and setting a locking mandrel in deviated wellbore tubing or tubing with viscous fluids are eliminated or reduced.

Another advantage is that the problems associated with abrupt stopping of a running tool and locking mandrel, which often cause a lower retainer pin in the running tool to shear when jarring to move the running tool and locking mandrel beyond a tubing restriction, are eliminated because the new lock mandrel is supported by the collet shifter and in turn its corresponding collet and not a lower retainer pin.

Still another advantage is that the new locking mandrel has keys that are biased inward until an upward force applied by the wireline or coil tubing pulls the expander mandrel upward Which then wedges against the locking keys and forces them outward into the nipple. Paraffin in wellbore tubing often accumulates in the tubing nipples. Paraffin buildup in the nipples will prevent lock keys of current locking mandrels from expanding into the nipple because current locking mandrels utilize springs alone to force the locking keys outward. The wedging of the keys in the new locking mandrel with the expander mandrel provides substantially more outward force on the locking keys than that provided by springs alone. The wedging of the locking keys with the expander mandrel of the new locking mandrel allows the locking keys to be more securely set within the locking profile the wellbore tubing nipples even in places where paraffin has accumulated.

Another advantage is that the new locking mandrel may be set into nipples that have been damaged or "washed out" by circulating wellbore fluids. Current locking mandrels have locking keys having a square locating shoulder that catches or locates by downward movement on the square shoulder of a nipple profile. If the square shoulders on the nipple profile or on the locking keys become worn or eroded, the locking keys of currently employed locking mandrels may not properly set into the nipple profile. Because the new locking mandrel is set using upward locating locking keys, setting requires only an enlarged tubing to allow the locking keys to expand fully. This allows the new lock mandrel to be set in the wellbore tubing even if the locking profile is worn or damaged.

These and other advantages of the new locking mandrel and running tool combination will be appreciated from the foregoing description.

These drawings may omit features that are well known and do not bear upon points of novelty in the interest of descriptive clarity. Such omitted features may include threaded junctures, weld lines, bolted fasteners, pins, screws, and brazed junctures.

DESCRIPTION OF EMBODIMENTS

Figure 1:
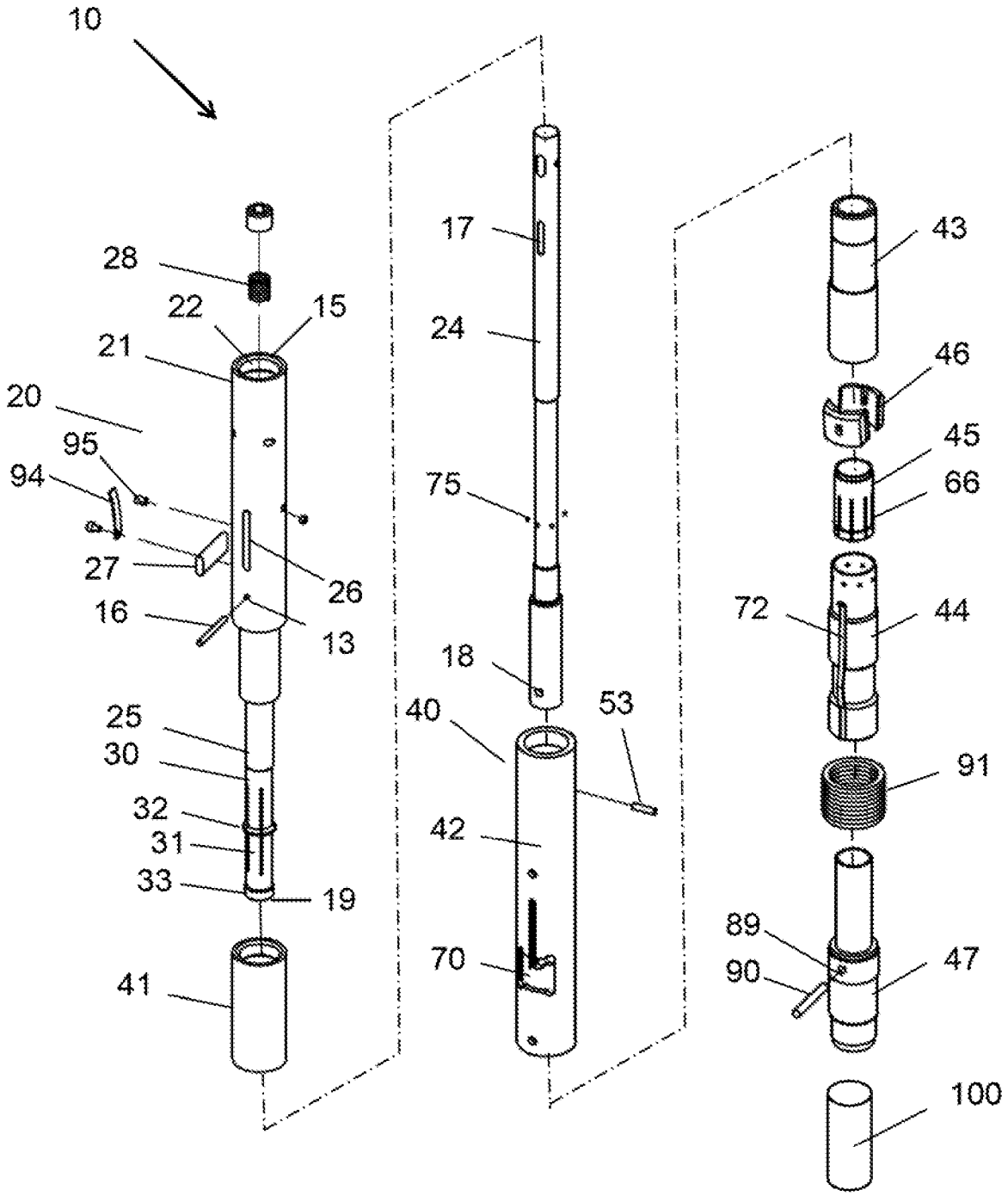
FIG. 1 is an exploded elevation view of the locking mandrel and running tool combination of this invention.
Figure 2:
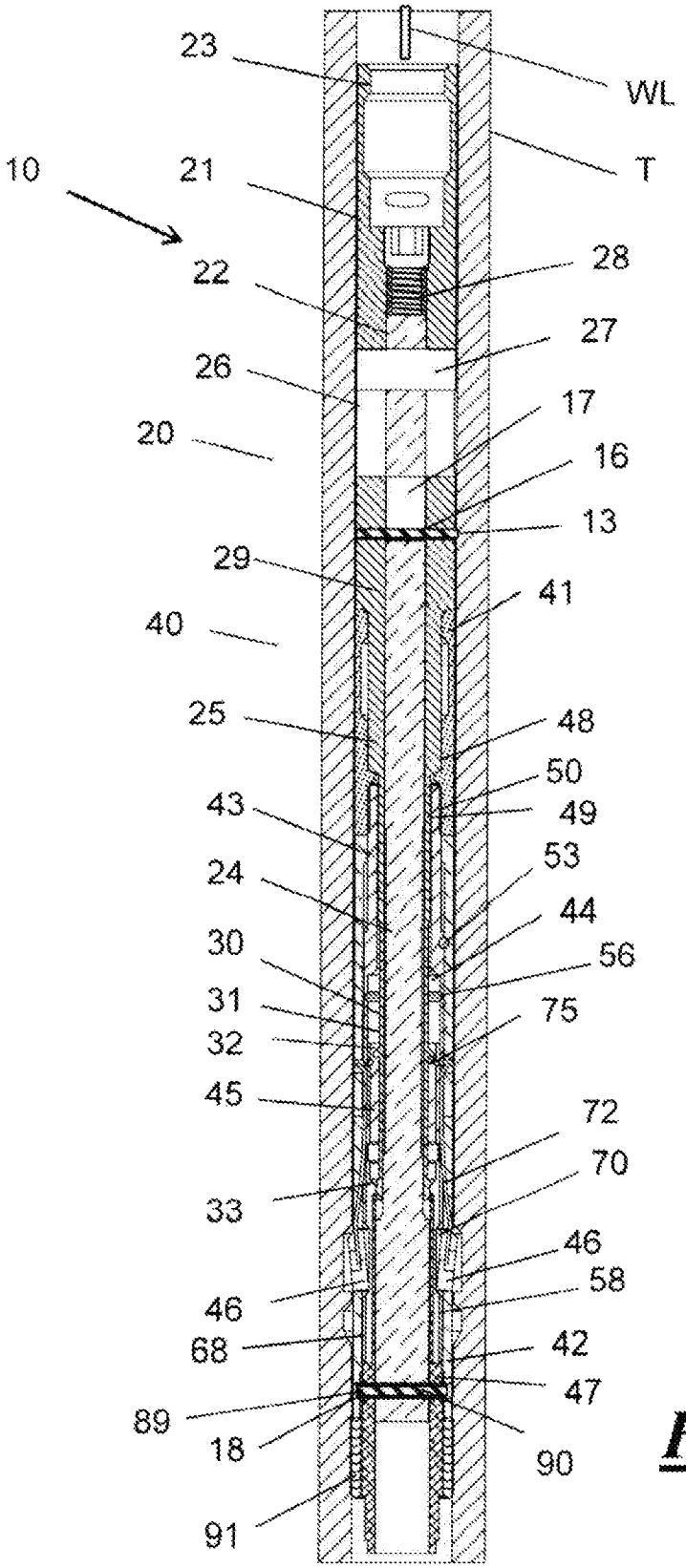
FIG. 2 is a longitudinal caress-sectional vie of the locking mandrel and running tool combination shown in FIG. 1 positioned in and configured for running into wellbore tubing.

Referring now to the drawings, particularly FIGS. 1 and 2, there is shown an embodiment of the new locking mandrel and running tool combination (10). Locking mandrel and running tool combination (10) is generally comprised of a locking mandrel (40) and a running tool (20) that are preferably run together by an extendable and retractable wireline (WL) of a wireline unit within wellbore tubing (T) having a plurality of landing nipples (N) each having recesses creating a locking profile (LP). A slickline unit, a coiled tubing unit, or other suitable tool running devices or equipment may also be used as a running mechanism for the locking mandrel to and running tool combination (10) and for the purpose of this description will be considered as the equivalent of a wireline (WL) of a wireline unit as a running mechanism.

As shown in FIGS. 1 and 2, the running tool (20) of the locking mandrel and running tool combination (10) has an upper end (15) and a lower, end (19). The upper end (15) has an upper housing (21) with central core (22) and an attachment neck or socket (23) for attachment of the running tool (20) to the wireline (WL). A collet shifter (25) extends longitudinally downward from the upper housing (21) and has a central core (29) that corresponds with the central core (22) of the upper housing (21), a collapsible central collet section (30), and a radially outwardly extending lower shoulder (33). The file collapsible central collet section (30) has a plurality of collapsible spring members (31). The collapsible spring members (31) each have a radially outwardly extending central shoulder (32). The collet shifter (25) may formed integrally with the upper housing (21) as shown or it may be a separate component that is attached to the upper housing (21) by pins or screws, by attachment threads, or other suitable attachment mechanisms.

The running tool (20) has a translatable actuation rod (24) positioned through the central core (29) of the collet shifter (25) and through the central core (22) of the upper housing (21). The actuation rod (24) is translatably attached to the upper housing (21) by a retainer pin (27) that extends through a translation slot (26) in the actuation rod (24). The actuation rod (24) is releasably secured to the upper housing (21) of the running tool (20) by a setting shear pin (16) positioned in a setting translation slot (17) in the actuation rod (24) and in a setting pin bore (13) in the upper housing (21) of the running tool (20). A shear pin bore (18) in the actuation rod (24) at the lower end (19) of the running tool (20) is provided for receiving shear pin (90) for releasable attachment of the running tool (20) to the locking mandrel (40).

The retainer pin (27) and translation slot (26) restrict the translation of the actuation rod (24) within the central core (22) of the upper housing (21) to the length of the translation slot (26). A leaf spring (94) attached to the upper housing (21) by bolts or screws (95) may be utilized to provide some releasable resistance to translation of the actuation rod (24) if necessary or warranted by the anticipated pulling or tension forces.

A tension spring (28) in the central core (22) of the upper housing (21) allows a downward bias to the actuation rod (24) and the tension spring (28) may be selected to provide a desired tension on the actuation rod (24). An optional retention mechanism (35) such as a pawl and spring ratchet mechanism (not shown) may be provided on the upper housing (21) to engage a notch or keyway in the actuation rod (24) (not shown) to prevent downward translation of the upper housing (21) and collet shifter (25) after the locking mandrel (40) is set.

The locking mandrel (40), shown in FIGS. 1 and 2, has a fishing neck (41) at its upper end, an outer tubular cylindrical lock housing (42), and a packing mandrel (47) threadedly attached to lock housing (42) at its lower end. The lock housing (42) defines an inward interior lock housing surface and outward exterior lock housing surface and encloses an expander mandrel receiver (43), a translatable expander mandrel (44), a translatable collet (45), and a plurality of locking keys (46).

Figure 6:
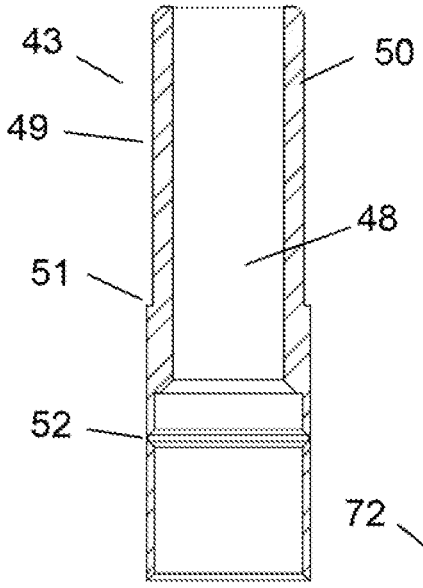
FIG. 6 is a longitudinal cross-sectional view of the expander mandrel receiver of the locking mandrel shown in FIG. 1.

The expander mandrel receiver (43), shown in detail in FIG. 6, has a central core (48) that corresponds with the central core (22) of the upper housing (21) of the running tool (20) which is configured for receiving the actuation rod (24) and collet shifter (25) of the running tool (20), a neck section (49) with external threaded attachment surface (50) for threaded attachment to the fishing neck (41), and an outwardly extending radial shoulder section (51). The radial shoulder section (51) of the expander mandrel receiver (43) also has an annular interior ball deters (52) that extends around central core (48).

Figure 7:
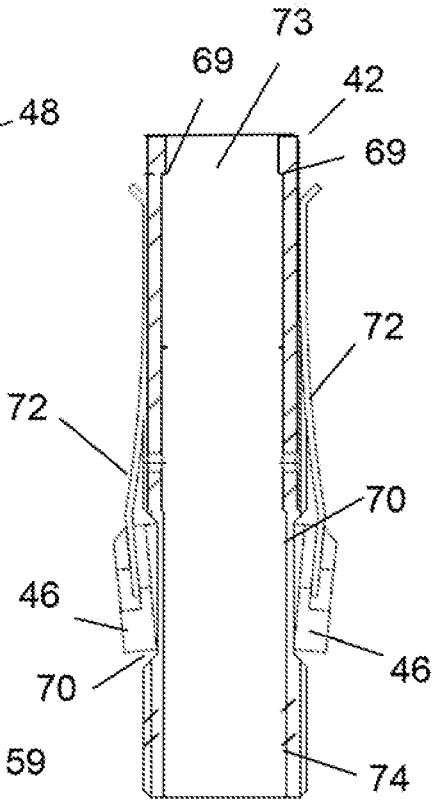
FIG. 7 is a longitudinal cross-sectional view of the lock housing of the locking mandrel shown in FIG. 1.

The lock housing (42), shown m detail in FIG. 7, is cylindrical with an interior central core (68), an upper annular shoulder (69) creating a shoulder opening (73) keyway openings (0), and a lower attachment end (71) with an internal threaded attachment surface (74). The locking keys (46) are positioned adjacent to the keyway openings (70) in the lock housing (42) and are biased inwardly at the keyway openings (70) toward the interior central core (68) of locking housing (42). A plurality of leaf springs (72) affixed to the lock housing (42) is provided to inwardly bias the locking keys (46) the keyway openings (70). Other biasing devices such as coiled springs may also be utilized.

Figure 8:
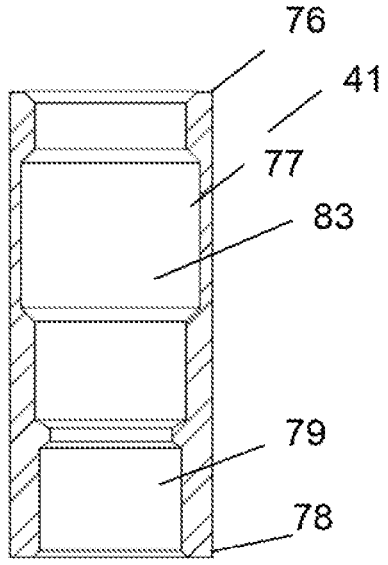
FIG. 8 is a longitudinal cross-sectional view of the fishing neck, of the locking mandrel shown in FIG. 1.

The fishing neck (41), shown in detail in FIG. 8, has an upper end (76), and lower end (78), and a central core (83) for receiving the actuation rod (24) and collet shifter (25) of the running tool (20). The lower end (78) of the fishing neck (41) has an internally threaded core (79) for threaded attachment to the external threaded attachment surface (50) of the expander mandrel receiver (43). The upper end (76) of fishing neck (41), within the central core (83), has an internal fish profile (77) adapted to receive and engage with conventional fishing or pulling tools used in wellbore operations.

The neck section (49) of the expander mandrel receiver (43) is inserted through the interior central core (68) and the shoulder opening (73) of the lock housing (42) where it is encircled by the upper annular shoulder (69) of the lock housing (42) and threadedly attached to the fishing neck (41). When the expander mandrel receiver (43) is so attached the lock housing (42) may translate upward and downward along neck section (49) of the expander mandrel receiver (43) between the fishing neck (41) and the radial shoulder section (51) of the expander mandrel receiver (43). Shear pins or shear screws (53) car their equivalents are preferably provided to releasably attach the lock housing (42) to the expander mandrel receiver (43) in a in fully upward position with respect to the fishing neck (41). One such equivalent may be a spring biased ball and ball detent.

Figure 9:
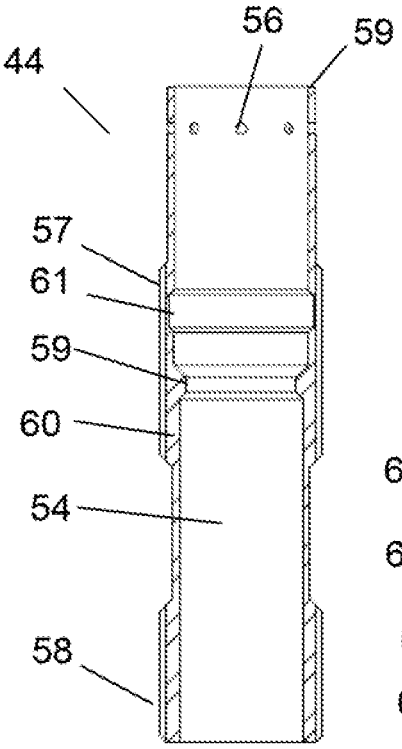
FIG. 9 is a longitudinal cross-sectional view of the translatable expander mandrel of the locking mandrel shown in FIG. 1.

The translatable expander mandrel (44), shown in detail in FIG. 9, has an upper end (55) with a plurality of ball recesses (56), a central outwardly extending radial shoulder (57), and a lower outwardly extending radial shoulder (58) and a central core (54) that corresponds with the central core (22) of the upper housing (21) of the running tool (20) for receiving the actuation rod (24) and collet shifter (25). The translatable expander mandrel (44) also has an interior annular shoulder (59) that extends radially inward from the interior surface (60) of the translatable expander mandrel (44) into the central core (54) and an interior annular collet finger detent (61) that extends around the interior surface (60) of the expander mandrel (44).

Figure 10:
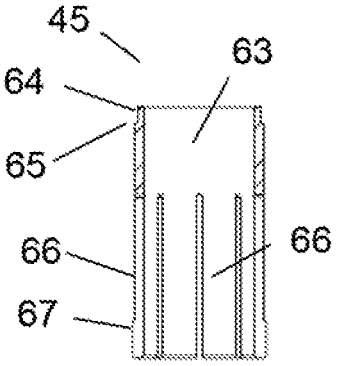
FIG. 10 is a longitudinal cross-sectional view of the translatable collet of the locking mandrel shown in FIG. 1.

Translatably fitted within the translatable expander mandrel (44) is the translatable collet (45), shown in detail in FIG. 10. The translatable collet (45) has a central core (63) for receiving the actuation rod (24) and collet shifter (25) of the running tool (20), a collet neck (64) abutting an outwardly extending radial collet shoulder (65), a plurality of collet fingers (66), each with a outward extending collet finger shoulder (67).

Figure 11:
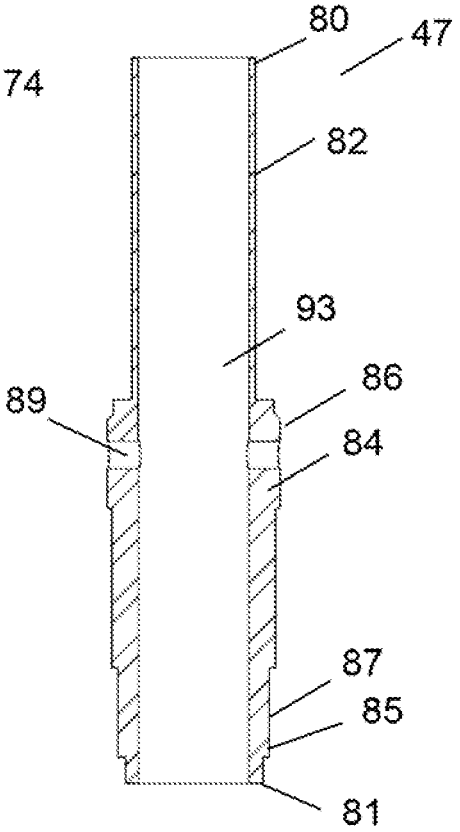
FIG. 11 is a longitudinal cross-sectional view of the packing mandrel of the locking mandrel shown in FIG. 1.

The packing mandrel (47), shown in detail in FIG. 11, has an upper end (80), lower end (81), a neck (12), and a central core (93) for receiving the actuation rod (24), and an upper shoulder (84) having an external threaded surface (86) for threaded attachment to the internal threaded attachment surface (74) at the lower attachment end (71) of the lock housing (42), and a lower shoulder (85) an external threaded surface (87) for attachment of other wellbore tools or equipment. Packing mandrel (47) has pin bore (89) that corresponds with the shear pin bore (18) in the actuation rod (24). A shear pin (90), inserted though pin bore (89) and shear pin bore (18), releasably attaches the actuation rod (24) to the lock housing (42) by way of the threadedly attached packing mandrel (47).

The locking mandrel and running tool combination (10) may be configured for running into wellbore tubing (T), as shown in FIGS. 2 through 5. The actuation rod (24) is inserted into the central core (29) of the collet shifter (25) and through the central core (22) of the upper housing (21), the actuation rod (24) is then translatably attached to the upper housing (21) by the retainer pin (27) extending through the translation slot (26) in the upper housing (21). The locking keys (46) with their respective leaf springs (72) are attached to the lock housing (42) at a position where the locking keys (46) are biased inwardly at the keyway openings (70) of the lock housing (42). The expander mandrel receiver (43) is inserted into the interior central core (68) of the lock housing (42) at the lower attachment end (71) so that the neck section (49) extends thorough the shoulder opening (73) in the upper annular shoulder (69) of the lock housing (42). The expander mandrel receiver (43) is then threadedly attached to the internally threaded core (79) of the fishing neck (41) by means of exterior threaded attachment surface (50). The lock housing (42) is then moved to a fully upward position with respect to the fishing neck (41) and is releasably attached to the expander mandrel receiver (43) by shear pins or shear screws (53) or their equivalents.

The translatable collet (45) is inserted into the translatable expander mandrel (44) at its upper end (55) and bearing balls (75) are placed into each of the ball recesses (56) of the expander mandrel (44). The translatable expander mandrel (44), with the translatable collet (45), is then inserted into the interior central core (68) of lock housing (42) from the lower attachment end (71). The packing mandrel (47) is then threadedly attached to the lock housing (42) at lower attachment end (71) by means of the external threaded surface (86) on upper shoulder (84) of the packing mandrel (47) and the internal threaded attachment surface (74) of the lock housing (42). Shear pin (90) is then inserted though pin bore (89) and shear pin bore (18) to releasably attach the actuation rod (24) to the lock housing (42) by way of the threadedly attached packing mandrel (47). Packing seals (91) may be placed between the lock housing (42) and the packing mandrel as may be required.

Once assembled the running tool (20) is then releasably attached to the outer locking (42) by inserting the collet shifter (25) with the attached translatable actuation rod (24) through the central core (83) of the fishing neck (41), the central core (48) of the expander mandrel receiver (43), the central core (54) of the translatable expander mandrel (44) and into the central core (93) of the packing mandrel (47) and pushing the upper housing (21) and actuation rod (24) downward so that the setting translation slot (17) is aligned with setting pin bore (13) and the shear pin bore (18) in the actuation rod (24) aligns with the pin bore (89) of the packing mandrel (47). Setting shear pin (16) is then releasably secured to the upper housing (21) through setting pin bore (13) and setting translation slot (17) in the actuation rod (24).

Figure 12:
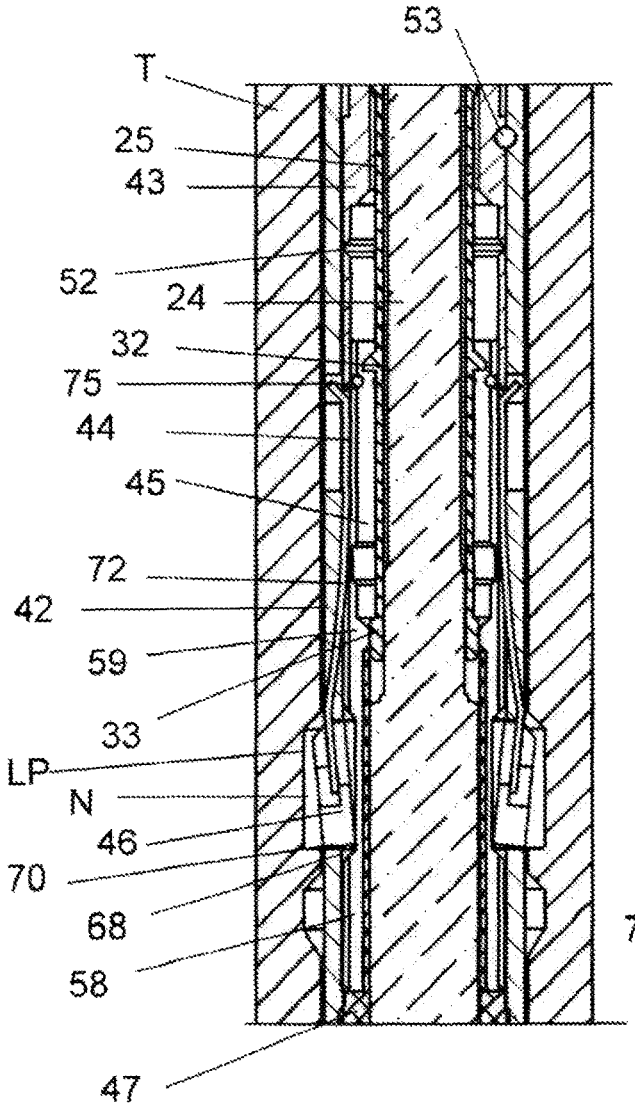
FIG. 12 is a partial longitudinal cross-sectional detail view of the locking mandrel and running tool combination of FIG. 1 configured for running into wellbore tubing.

The locking mandrel and running tool combination (10), with an attached tool (100) such a flow control device, may then be attached at the attachment neck or socket (23) to a wireline, slickline, or other such insertion techniques and run into wellbore tubing (T) as shown in FIG. 2 and FIG. 12. When so inserted the locking mandrel and running tool combination (10) and the attached tool (100) are moved downward through the wellbore tubing (T) and through as many downhole nipples as necessary to reach a desired nipple (N) where the locking, mandrel (40) is to be set. The locking mandrel (40) is moved downward beyond the desired landing nipple (N), or at least to a position where the keyway openings (70) and locking keys (46) are downward from the locking profile (LP) of the nipple (N). When so positioned, the locking mandrel and running tool combination (10) with the attached tool (100) are then pulled upward by the wireline (WL).

Figure 3:
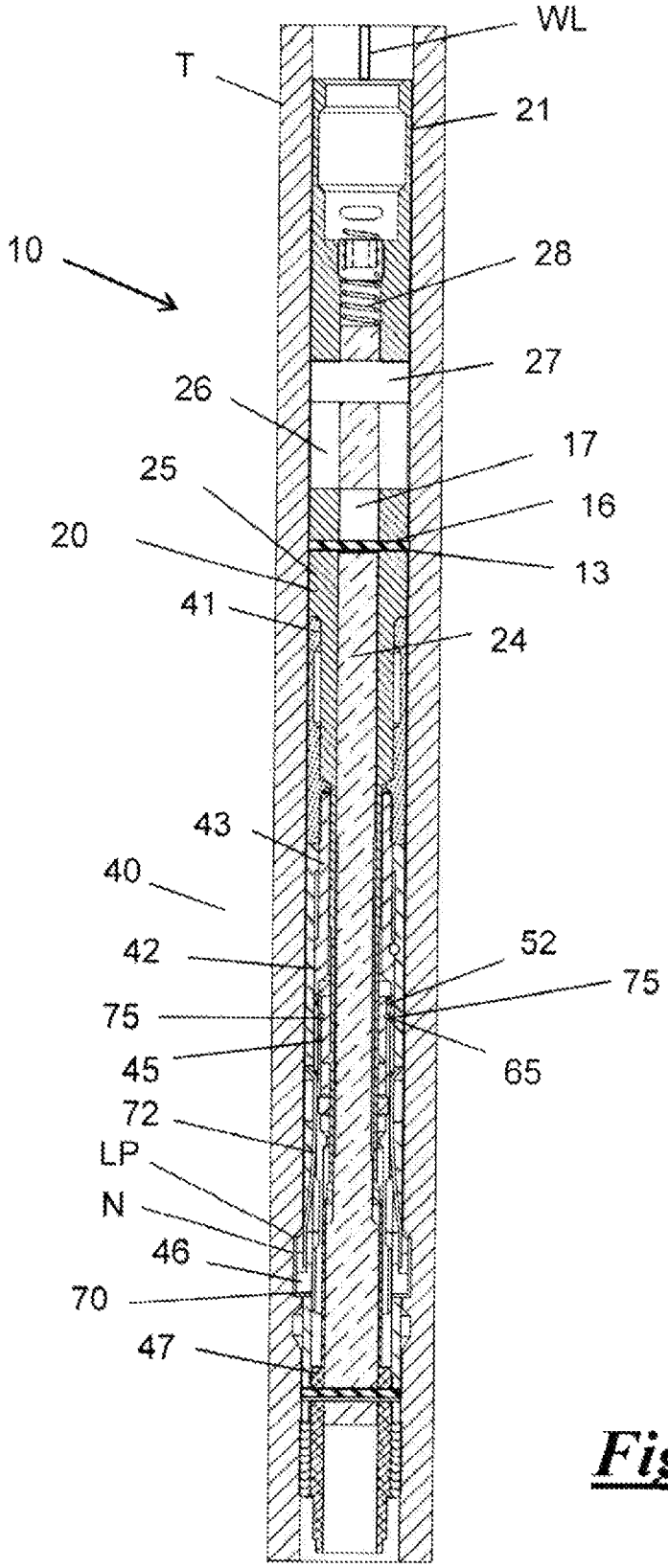
FIG. 3 is a longitudinal cross-section view of the locking mandrel and running tool combination of FIG. 1 in a setting engagement with a desired landing nipple of wellbore tubing.
Figure 13:
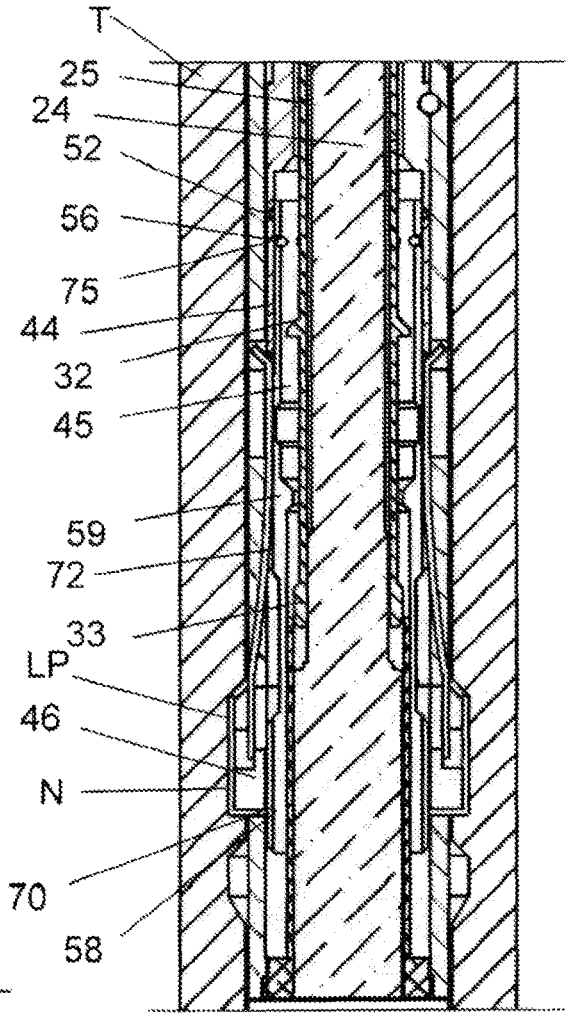
FIG. 13 is a partial longitudinal cross-sectional detail view of the locking mandrel and running tool combination of FIG. 1 in a pre-setting engagement with a desired landing nipple of wellbore tubing.

This upward movement shifts the upper housing (24) and collet shifter (25) of the running tool (20) upward in relation to the locking mandrel (40) as shown in FIG. 3 and FIG. 13. As shown in FIG. 13, the upward translation of upper housing (21) of the running tool (20) is restrained, by the retainer pin (27) in the translation slot (26) of the actuation rod (24) to keep the translatable collet (45) and translatable expander mandrel (44) from fully translating upward into the expander mandrel receiver (43) to prevent the locking mandrel (40) from being set in an undesirable location in the wellbore tubing such as a wellbore cavity or recess other than the recesses of a nipple locking profile.

Figure 4:
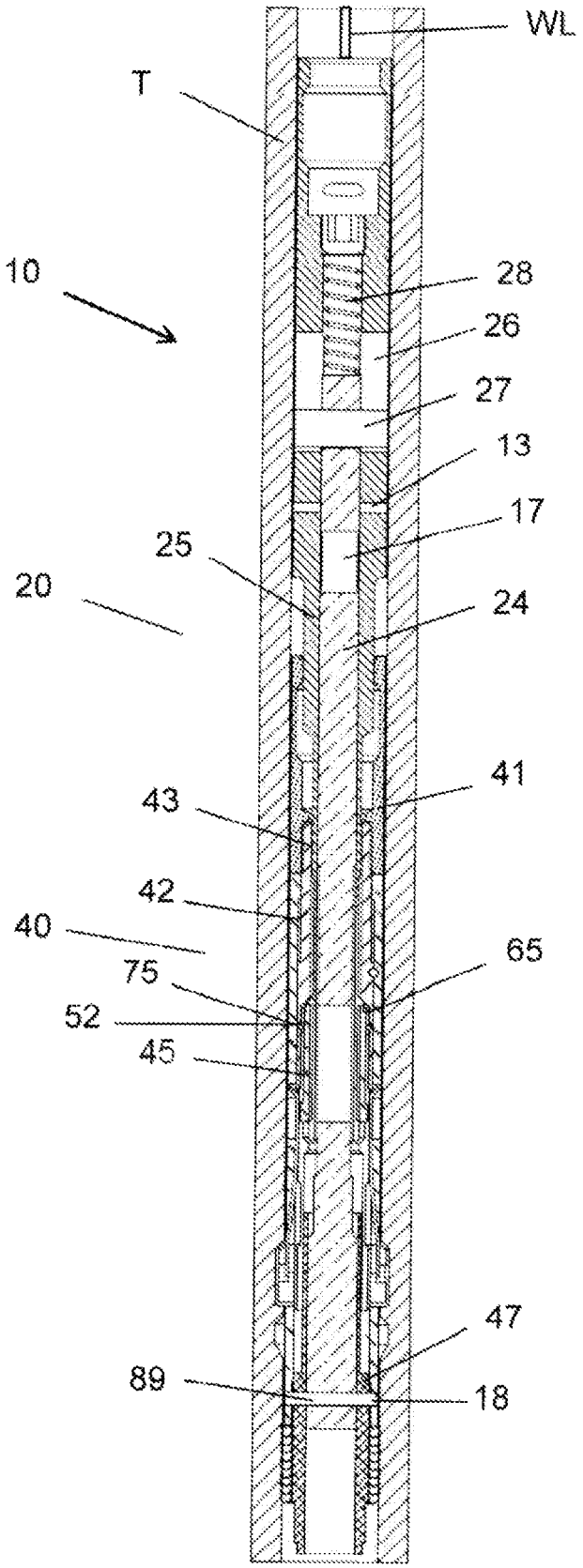
FIG. 4 is a longitudinal cross-section view of the locking mandrel and running tool combination of FIG. 1 during disengagement of the running tool from the locking mandrel.
Figure 14:
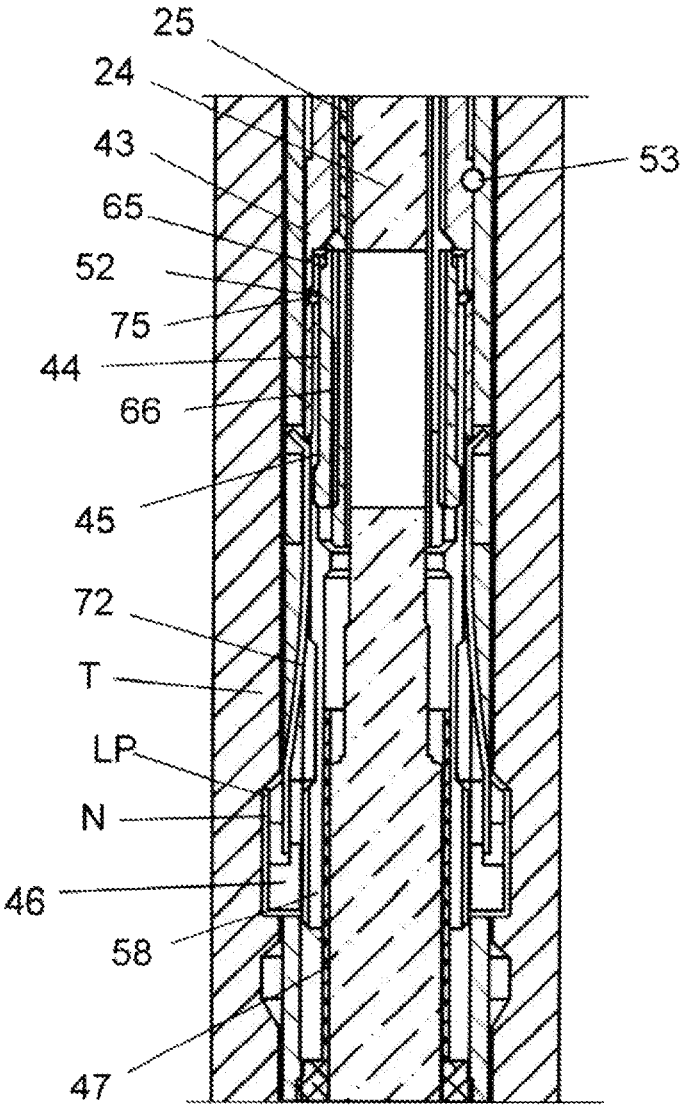
FIG. 14 is a longitudinal cross-section detail view of the locking mandrel of the locking mandrel and running tool combination of FIG. 1 set and engaged with a desired landing nipple of wellbore tubing.

With the locking keys (46) recessing into the locking profile (LP) of the nipple (N), upward jarring or over-pull is applied to running tool (20) to translate the upper housing (21) and collet shifter (25) upward to shear or sever the setting shear pin (16) to allow the upper housing (21) and collet shifter (25) to be completely shifted upward to set the locking mandrel (40). When the upper housing (21) and collet shifter (25) are fully shifted upward, the bearing balls (75) in the ball recesses (56) of the translatable expander mandrel (44) are forced outward by the translation of the translatable collect (45) into the corresponding annular interior ball detent (52) in the expander mandrel receiver (43) thereby allowing the translatable collet (45) to continue to travel upward here each collet finger shoulder (67) on the collet fingers (66) expands outward from the lower shoulder (33) of the collet shifter (25) to engage with the interior annular collet finger detent (61) in the translatable expander mandrel (44), as shown in FIG. 4 and FIG. 14. The engagement of the collet fingers (66) within the interior annular collet finger detent (61) keeps the translatable collet (45) firmly behind the bearing balls (75) and locks the translatable expander mandrel (44) to the expander mandrel receiver (43) and inwardly flex the collapsible central collet section (30) to shift each central shoulder (32) of the collet shifter (25) inward.

Figure 5:
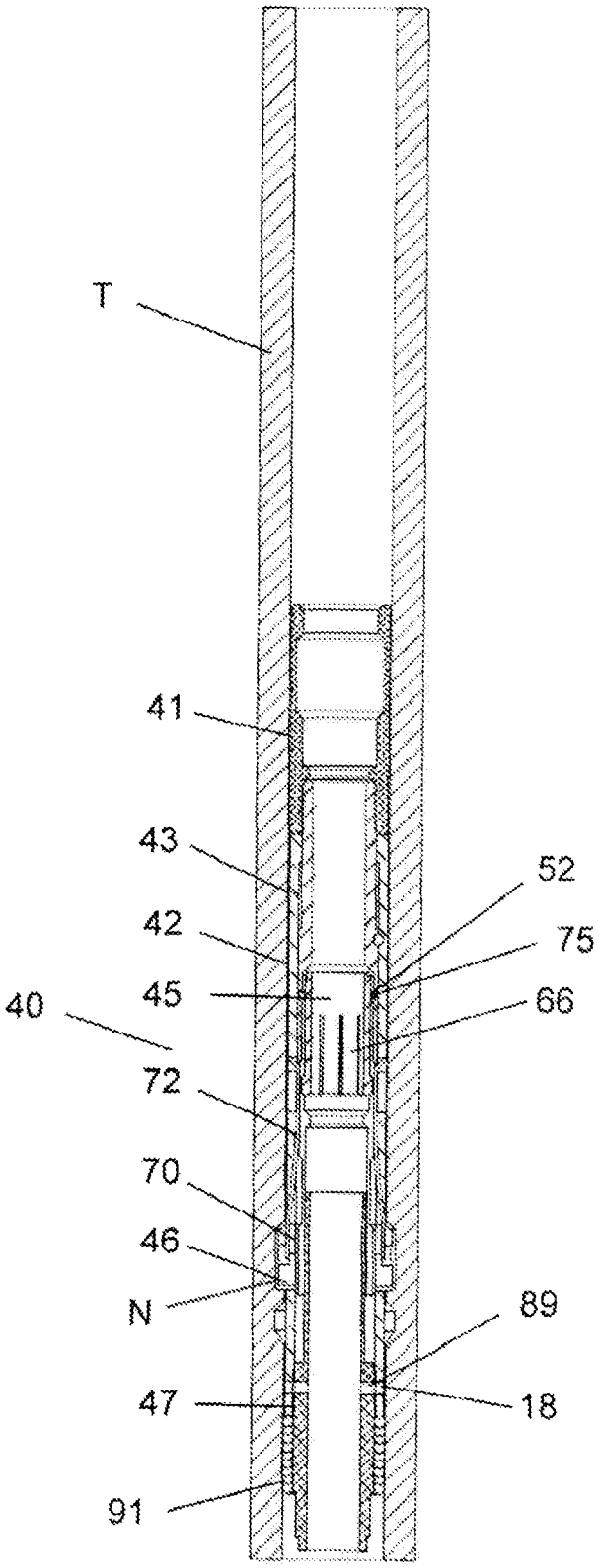
FIG. 5 is a longitudinal cross-section view of the locking mandrel of the locking mandrel and running tool combination of FIG. 1 with the locking mandrel disengaged from the running tool and positioned in a desired landing nipple in the wellbore tubing.
Figure 15:
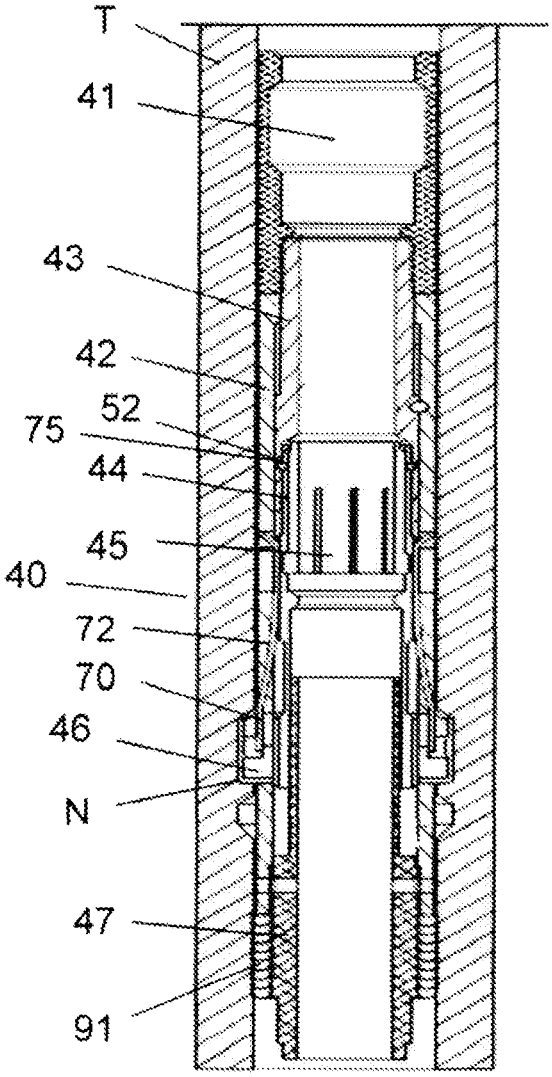
FIG. 15 is a longitudinal cross-section view of the locking, mandrel of FIG. 1 set into a desired landing nipple of wellbore tubing.

The upward translation of the upper housing (21) and collet shifter (25) and the translatable expander mandrel (44) will also engage the lower outwardly extending radial shoulder (58) of the translatable expander mandrel (44) with the locking keys (46) and fully push the locking keys (46) outwardly through the keyway openings (70) into the recess of the locking profile (LP) of the nipple (N) to set the locking mandrel (40). The running tool (20) is then jarred upward to shear the shear pin (90) attaching the actuation rod (24) of the running tool (20) to the lock housing (42). The running tool (20) is then retrieved from the wellbore tubing (T) by the wireline (WL) leaving the locking mandrel (40) set in the nipple (N) as shown in FIG. 5 and FIG. 15.

If the desired nipple (N) is a restricted bottom nipple such as an OTIS® No-Go® nipple, locking keys (46) with a profile that conforms to the profile of the restricted bottom nipple may be utilized. The locking mandrel and running tool combination (10) is then run into the wellbore tubing (T) until the locking mandrel (40) is located downward of the nipple restriction such as in the bottom of the "XN" nipple profile of a No-Go® nipple. The locking mandrel (40) may then be set using the same setting procedure as described above.

Figure 16:
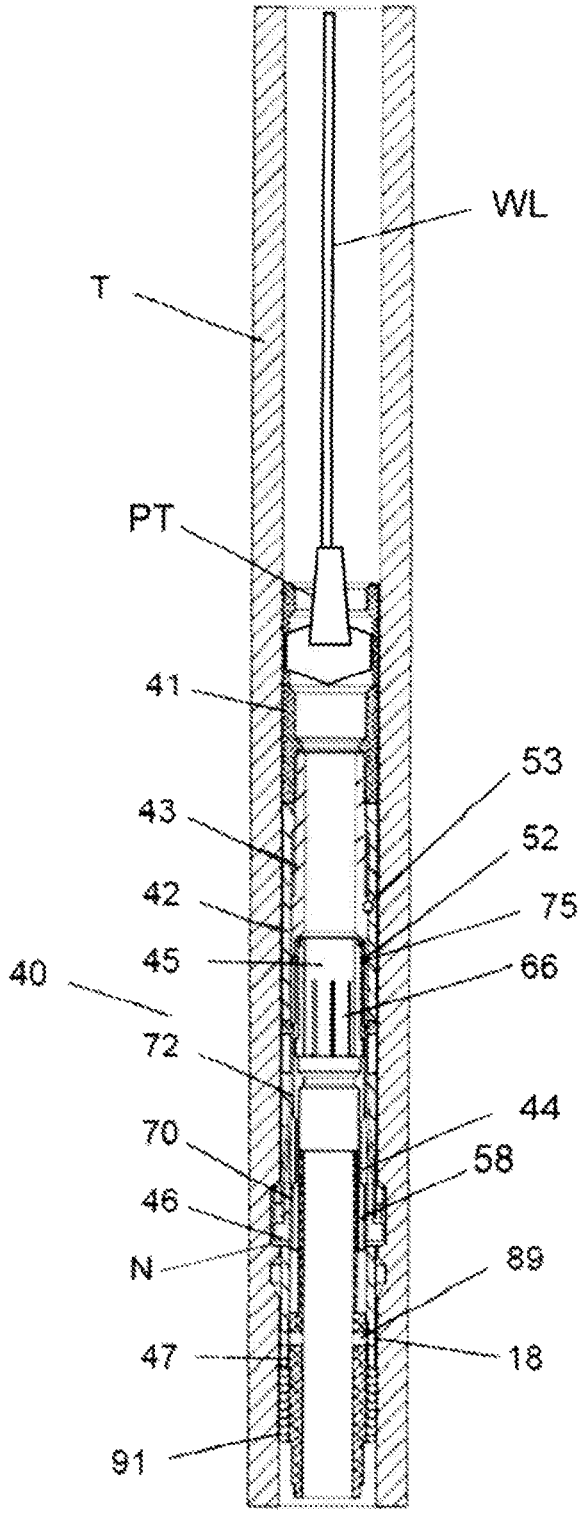
FIG. 16 is a longitudinal cross-section view of the locking mandrel of FIG. 1 attached to a pulling tool for pulling the locking mandrel from wellbore tubing.

If at a later date the locking mandrel (40) must be pulled from the wellbore tubing (T), a pulling tool (PT), such as an OTIS® Go® pulling tool, as shown in FIG. 16, is attached to a wireline (WL) or other suitable tool running mechanism and used to latch into the fishing neck (41) at the top of the locking mandrel (40). Upward force or jarring on the fishing neck (41) will shear the shear pins or shear screws (53) at the lock housing (42) allowing the expander mandrel receiver (43) and connected translatable expander mandrel (44) to be shifted upward to a point where the radial shoulder (58) of the translatable expander mandrel (44) is above the locking keys (46) to allow the inwardly biased locking keys (46) to retract inward into the lock housing (42) to clear the keyway openings (70) in the lock housing (42). When the locking keys (46) are retracted inward into the lock housing (42) to clear the keyway openings (70), the locking mandrel (40) may be freely pulled from the wellbore tubing (T).

It is thought that the locking mandrel and running tool combination (10) and method of the present invention and many of their attendant advantages will be understood from the foregoing description and it will be apparent that various changes may be made in the form, construction and arrangement of the parts thereof without departing from the spirit and scope of the invention or sacrificing all of its material advantages.

I claim:

1. A locking mandrel and running tool combination for setting equipment in wellbore tubing comprising:

(a) running tool;

(b) a locking mandrel releasably attached to said running tool, said locking mandrel having a tubular housing with an interior central core, an inward interior housing surface and an outward exterior housing surface;

(c) a keyway positioned on said tubular housing, said keyway creating an opening extending from said outward exterior housing surface into said central core of said tubular housing;

(d) a locking key positioned at said keyway, said locking key biased inward from said outward exterior housing surface;

(e) a tubular translatable expander mandrel positioned within said tubular housing, said tubular expander mandrel translatably engagable with said locking key, said expander mandrel having an exterior radial shoulder, an interior annular collet finger detent, a plurality of ball recesses and a bearing ball in each said ball recess of said plurality of ball recesses;

(f) an expander mandrel receiver having an outwardly extending radial shoulder section with an annular interior ball detent, said expander mandrel receiver attached into said housing of said locking mandrel; and (g) a translatable collet having a plurality of collet fingers with an outward extending collet finger shoulder inserted into said translatable expander mandrel through said expander mandrel receiver whereby upward translation of said translatable collet forces said bearing balls from said ball recess of said expander mandrel into said annular ball detent of said expander mandrel receiver thereby allowing said translatable collet to travel upward within said translatable expander mandrel to outwardly expand each said collet finger to engage said collet finger shoulders with said interior annular collet finger detent of said translatable expander mandrel and engage said radial shoulder of said translatable expander mandrel with said locking keys and push said locking keys outward through said keyways.

2. The locking mandrel and running tool combination recited in claim 1 wherein said expander mandrel may be releasably locked in position within said tubular housing thereby releasably locking said locking key in said keyway in a position outward from said exterior housing surface.

3. The locking mandrel and running tool combination recited in claim 2 wherein said running tool includes a translatable actuation rod whereby translation of said translatable actuation rod translates said expander mandrel.

4. The locking mandrel and running tool combination recited in claim 3 wherein said translatable collet is positioned around said translatable actuation rod, wherein said translatable collet translates in response to translation of said translatable actuation rod to engage said translatable expander mandrel and thereby move said locking key outward from said keyway.

5. The locking mandrel and running tool combination recited in claim 4 wherein said translatable actuation rod is releasably restrained from translation by a shear pin.

6. The locking mandrel and running tool combination recited in claim 5 wherein said running tool and said locking mandrel are run together within wellbore tubing.

7. The locking mandrel and running tool combination recited in claim 6 wherein said wellbore tubing includes a locking nipple and whereby said locking key may be releasably engaged with said locking nipple by said outward movement of said locking key from said keyway of said locking mandrel.

8. The locking mandrel and running tool combination recited in claim 7 wherein said running tool is released from said locking mandrel and removed from the wellbore whereby said locking mandrel will remain within said wellbore with said locking key releasably engaged with said locking nipple.

9. The locking mandrel and running tool combination recited in claim 8 wherein said locking mandrel is attached to a wellbore tool.

10. A locking mandrel and running tool combination for setting equipment in wellbore tubing comprising:

(a) running tool, said running tool having an upper end and a lower end, said upper of said running tool having an upper housing with a central core, an attachment neck, a collet shifter extending longitudinally downward from said upper housing to said lower end of said running tool, said collet shifter having a central core that corresponds with said central core of said upper housing, a lower shoulder, a collapsible collect section having a plurality of collapsible spring members, each said collapsible spring member of said collet section having a radially outward extending central shoulder, and a translatable actuation rod positioned through said central core of said collet shifter and through said central core of said upper housing, said actuation rod translatably attached to said upper housing by a retainer pin that extends through a translation slot in said actuation rod, said actuation rod releasably secured to said upper housing by a setting shear pin positioned in a setting translation slot in said actuation rod and in a setting pin bore in said upper housing of said running tool, said actuation rod having a shear pin bore at said lower end of said running tool;

(b) a tension spring in said central core of said upper housing of said running tool providing a downward bias to said actuation rod;

(c) a cylindrical lock housing with an outward exterior lock housing surface and an interior central core defining an interior lock housing surface, an upper inwardly extending annular shoulder creating a shoulder opening into said interior central core of said lock housing, a plurality of keyways through said exterior lock housing surface into said central core of said lock housing into said openings, and a lower attachment end with an internal threaded attachment surface;

(d) a locking key positioned adjacent each keyway of said plurality of keyways, each said locking key biased inwardly toward said interior central core of said lock housing;

(e) a fishing neck having a central core wherein said actuation rod and collet shifter of said running tool is received, an upper end having an internal profile adapted for connection with a wellbore fishing tool, and a lower end having an internally threaded core;

(f) an expander mandrel receiver having a central core that corresponds with said central core of said upper housing of said running tool, said central core of said expander mandrel receiver configured for receiving said actuation rod and said collet shifter of said running tool, a neck section having an exterior threaded attachment surface, and an outwardly extending radial shoulder section, said radial shoulder section of said expander mandrel receiver having an annular interior ball detent, said expander mandrel receiver inserted into said interior central core of the lock housing whereby said neck section extends thorough said shoulder opening of said lock housing and threadedly attached to said internally threaded core at said lower end of said fishing neck by means of said exterior threaded attachment surface of said neck section of said expander mandrel receive;

(g) shear pins releasably attaching said expander mandrel receiver to said lock housing with said lock housing at fully upward position with respect to said fishing neck;

(h) a translatable expander mandrel having an upper end with a plurality of ball recesses, a central outwardly extending radial shoulder, and a lower outwardly extending radial shoulder, a central core that corresponds with said central core of said upper housing of the running tool for receiving said actuation rod and collet shifter, an interior annular shoulder extending radially inward into said central core of said translatable expander mandrel, and an interior annular collet finger detent;

(i) a translatable collet having a central core wherein said actuation rod and said collet shifter of said running tool is received, a collet neck abutting an outwardly extending radial collet shoulder, and a plurality of collet fingers, each said collet finger of said plurality of collet fingers having an outward extending collet finger shoulder, said translatable collet inserted into said translatable expander mandrel with a bearing ball placed into each of said ball recess of said plurality of ball recesses of said expander mandrel;

(j) a packing mandrel having an upper end, a lower end, a neck, and a central core wherein said actuation rod is received, a lower shoulder having an external threaded surface whereby wellbore tools or equipment are attached, a pin bore corresponds with said shear pin bore in said actuation rod at said lower end of said running tool, and an upper shoulder having an external threaded surface threadedly attaching said packing mandrel to said internal threaded attachment surface of said lower attachment end of said lock housing; and (k) a shear pin inserted though said pin bore of said packing mandrel and said shear pin bore of said actuation rod thereby releasably attaching said actuation rod to said lock housing.

11. The locking mandrel and running tool combination recited in claim 10 wherein said running tool and said locking mandrel are run together within wellbore tubing, said wellbore tubing having a plurality of landing nipples with locking profiles.

12. The locking mandrel and running tool combination recited in claim 11 wherein said running tool and said locking mandrel are positioned downward in said wellbore tubing to a position where said keyways and said locking keys are downward from desired landing nipples of said plurality of landing nipples, whereby when said running tool and said locking mandrel are pulled upward, said upper housing and collet shifter of said running tool shift upward in relation to said locking mandrel to translate said translatable collet upward and thereby force said bearing balls in said ball recesses of said translatable expander mandrel outward into said annular ball detent in said expander mandrel receiver thereby allowing said translatable collet to travel further upward within said translatable expander mandrel where each said collet finger shoulder on said collet fingers expands outward from said lower shoulder of the collet shifter to engage with said interior annular collet finger detent in said translatable expander mandrel.

13. The locking mandrel and running tool combination recited in claim 12 wherein said upward translation of said upper housing and said collet shifter of said running tool and said translatable expander mandrel will engage said radial shoulder of said translatable expander mandrel with said locking keys and push said locking keys outward through said keyways into said locking profile of said landing nipple and thereby set the locking mandrel in place on said wellbore tubing.

14. The locking mandrel and running tool combination recited in claim 13 wherein when said locking mandrel is set in place on said wellbore tubing, upward jarring of said running tool and said locking mandrel will shear said shear pin attaching said actuation rod of said running tool to said lock housing thereby releasing said running tool from said locking mandrel for retrieval from said wellbore tubing with said locking mandrel set in place on said wellbore tubing.

15. The locking mandrel and running tool combination recited in claim 14 wherein said locking mandrel is attached to a wellbore tool.

* * * * *